United States Patent [19]

Williams

[11] 4,210,305

[45] Jul. 1, 1980

[54] COMPOSITE FORMS FOR CONSTRUCTING CONCRETE WALLS

[76] Inventor: Chester I. Williams, 347 Greenbriar, SE., Grand Rapids, Mich. 49506

[21] Appl. No.: 946,436

[22] Filed: Sep. 27, 1978

[51] Int. Cl.[2] ..... E04G 11/06

[52] U.S. Cl. ..... 249/191; 249/42; 249/44; 249/47; 249/165; 249/166; 249/192

[58] Field of Search ..... 249/190, 191, 192, 194, 249/165, 166, 40, 213, 44, 42, 45, 47

[56] References Cited

U.S. PATENT DOCUMENTS

| | | | |
|---|---|---|---|
| 2,133,574 | 10/1938 | Roemisch | 249/213 |
| 2,523,131 | 9/1950 | Martin | 249/190 |
| 2,526,529 | 10/1950 | Arrighini et al. | 249/44 |
| 3,385,555 | 5/1968 | Williams | 249/192 |
| 3,690,613 | 9/1972 | Shoemaker | 249/40 |
| 3,905,574 | 9/1975 | Brauer | 249/191 |
| 3,977,647 | 8/1976 | Williams | 249/191 |
| 4,076,206 | 2/1978 | Marseillan | 249/44 |
| 4,151,975 | 5/1979 | Williams | 249/44 |

*Primary Examiner*—Donald J. Arnold
*Attorney, Agent, or Firm*—Glenn B. Morse

[57] ABSTRACT

A form system for constructing concrete walls is assembled from groups of laterally-interconnected units that are spaced to define the opposite surfaces of the wall. Tie systems traverse the space and matching edge discontinuities in adjacent units, with the pressure of the poured concrete being transferred from the form units to the tie systems by cross pins directly intersecting components of the tie systems and the marginal frame members of the units at the edge discontinuities. Transverse frame members provide mounting points for studs that interengage to laterally locate a pair of form units placed back-to-back, and members provide protected storage positions for tie components when they are not in use. Handles, and also fastenings securing panels to the frames, are positioned within the space enclosed by the frames to avoid interference in the back-to-back storage position of the units.

8 Claims, 9 Drawing Figures

COMPOSITE FORMS FOR CONSTRUCTING CONCRETE WALLS

BACKGROUND OF THE INVENTION

Concrete walls are usually constructed by erecting form panels in parallel spaced relationship, and then pouring concrete in the space between the forms. A wide variety of structural designs have been developed for these forms, with the design details being influenced by the amount of repeated use of the form sections and the method of securing and handling them. The securing of these forms in spaced relationship as the concrete is poured represents the most serious problem to the form designer. The newly poured concrete generates a pressure of around one hundred and sixty pounds per square foot per foot of height of the pour, and this is usually handled by providing tie systems that traverse the space between the forms, and are connected to the form structure with fastenings having the ability to transfer the extremely heavy forces that are concentrated at these ties from the distributed forces over the forming face that confines the concrete.

One of the most effective types of tie systems involves the use of a tie rod that remains embedded in the poured concrete, and is connected at its opposite ends to a bolt secured in one of a number of possible ways to the form structure. The forms are "stripped" from the set concrete by removing these bolts, and thus freeing the forms for removal and replacement. The forms that are frequently reused are usually made of metal, and the design of forms with metal frames that are adapted for the bolt-type tie systems has presented rather difficult problems in providing for the stress concentration at the points of transfer of the distributed pressure forces to the tie components. My co-pending application Ser. No. 845,080 filed Oct. 25, 1977 and now U.S. Pat. No. 4,151,975 describes and claims a type of metal form having edge discontinuities for receiving the bolt components of such tie systems, and provides also for the transfer of the primary pressure forces by a cross pin bearing against the outer edge of the marginal frame members of the form. Light cross pins are shown used (in conjunction with the primary load cross pins) for maintaining initial form spacing prior to pouring. It is often desirable to change or replace the form panels themselves, or to incorporate various irregularities in the forming surface to provide corresponding design configurations in the surface of the wall. With this in mind, it is useful to have the metal frames of the forms adapted to receive and support replaceable plywood panels.

The use of relatively small form sections secured edge-to-edge makes it possible to reduce the size and weight of the individual units to the point that they can be handled manually. The resulting number of these emphasizes the importance of making them readily capable of assembly and disassembly. This, in turn, establishes the importance of a convenient storage position of the forms, and for some manner of retaining the bolt elements of the tie system when the forms are not in use. These have normally been tossed into a bin, and then recovered at some later time and carried to the point of erection of the forms. The forms themselves have commonly been stacked in a manner such that the forming face is relatively vulnerable to damage from the stacking procedure. The present invention is directed particularly at these problems.

SUMMARY OF THE INVENTION

A wall form unit has a metal frame with marginal discontinuities that align to accommodate bolts when similar form units are secured together in coplanar relationship. Cross pins intersect the discontinuities and the bolts to position the forms and provide for stress-transfer. Alignment projections on the units interengage when the form units are placed back-to-back, defining a protected space for storing the bolts and other components of a tie system. Form panels are secured to the frames by fastenings located within the space defined by the frames.

DESCRIPTION OF THE PREFERRED EMBODIMENT

Figure 1:
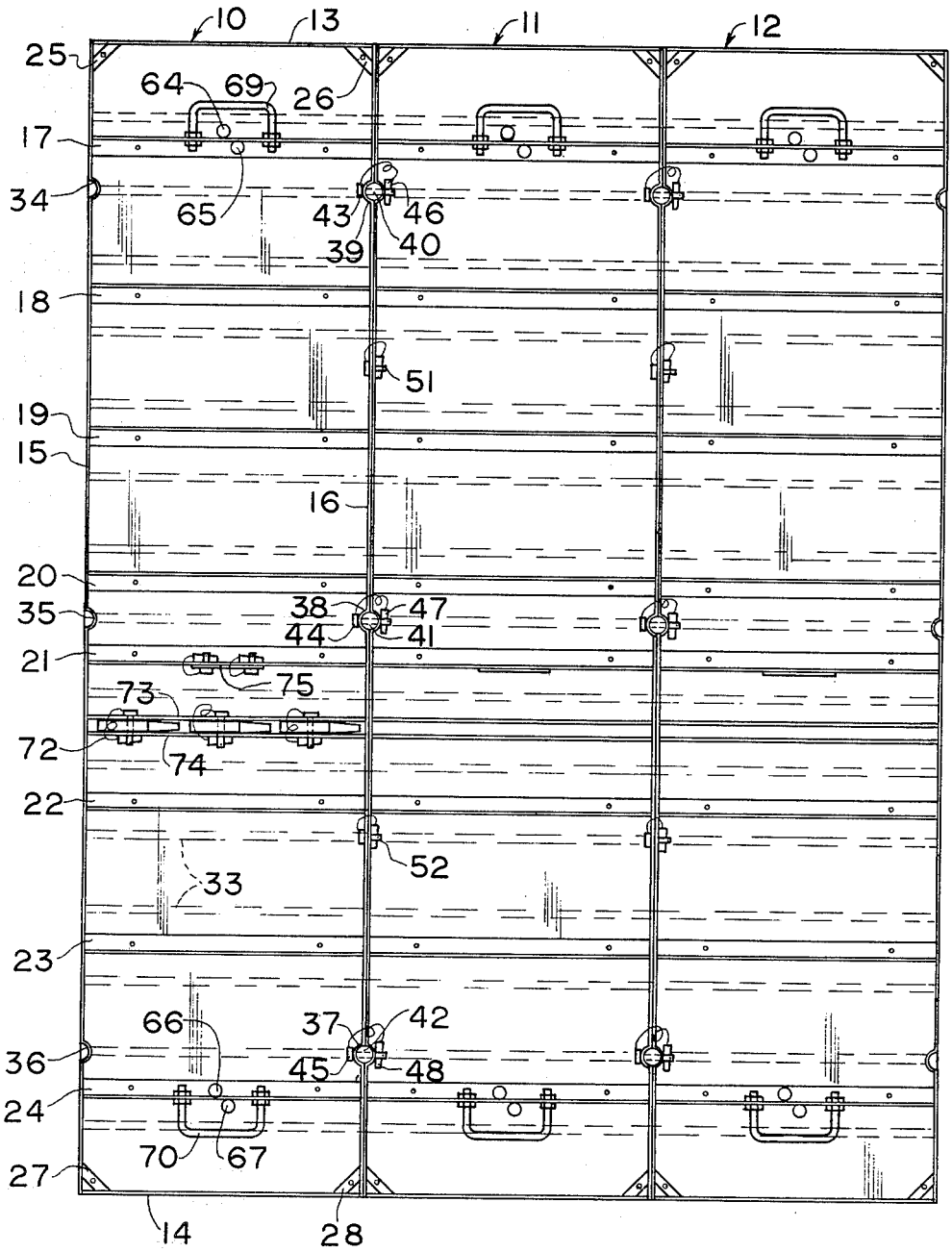
FIG. 1 is a front elevation showing a group of three form units secured together laterally, with tie systems installed interconnecting these units with corresponding units on the opposite side of the wall space.
Figure 5:
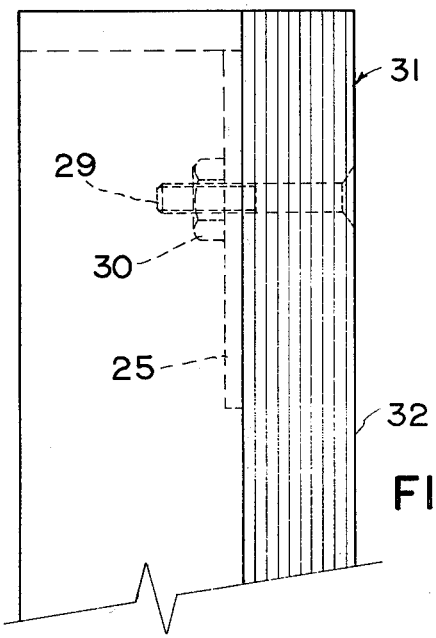
FIG. 5 is a view on an enlarged scale showing the securing of a plywood panel to the metal frame of a form unit.

The section of a wall form installation shown in FIG. 1 includes the form units 10, 11, and 12 that are laterally interconnected in edge-to-edge relationship to establish a coplanar forming surface. The form units shown in FIG. 1 are identical, and only one of these will be described in detail. The unit 10 has a frame including the top and bottom members 13 and 14, and the opposite side members 15 and 16, respectively. The side 16 of unit 10 is in abutting relationship to the corresponding side 15 of unit 11. A series of transverse members 17–24 interconnects the side members 15 and 16, with these components being preferably welded in the illustrated configuration. The diagonal corner members 25–28 are also welded in place to form securing points for fastenings such as the bolts 29 and the nuts 30 shown in FIG. 5 securing the plywood panel 31 to the frame of the unit 10. The forming face 32 of this panel may be left completely coplanar, or may be provided with strips as shown at 33 for establishing grooves in the poured concrete.

Figure 3:
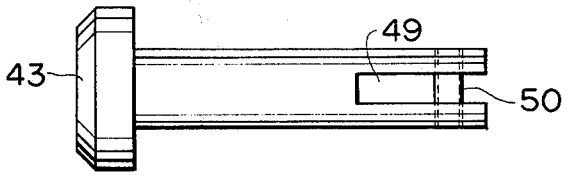
FIG. 3 is a side elevation on an enlarged scale of a cross pin traversing the frame members and the tie bolts.

The side members 15 and 16 of the frames are provided with semicircular discontinuities as shown at 34–39 that are aligned with corresponding discontinuities in adjacent panel units to provide an opening for receiving bolt components as shown at 40–42 in FIG. 1. The panels are drilled or routed out at these points either on a jig, or when adjacent form elements are clamped together at the flanges to form a guide for the machining operation. These bolt components, and also the adjacent frame discontinuities, are traversed by cross pins 43–45. A clamping action is generated on these pins tending to hold the form units together by the wedges 46–48 traversing the slots 49 (refer to FIG. 3), and acting between the frame members and the abutments 50. The taper of these wedges results in a clamping action that brings the marginal frame members solidly against the bolts for the most effective shear transfer of the heavy forces transmitted through the tie systems from the distributed pressure of the poured concrete. To maintain an effective seal at the junction of the panel units, it is preferable to incorporate similar auxiliary fastening assemblies as shown at 51 and 52, which are unrelated to the cross-tie systems.

Figure 2:
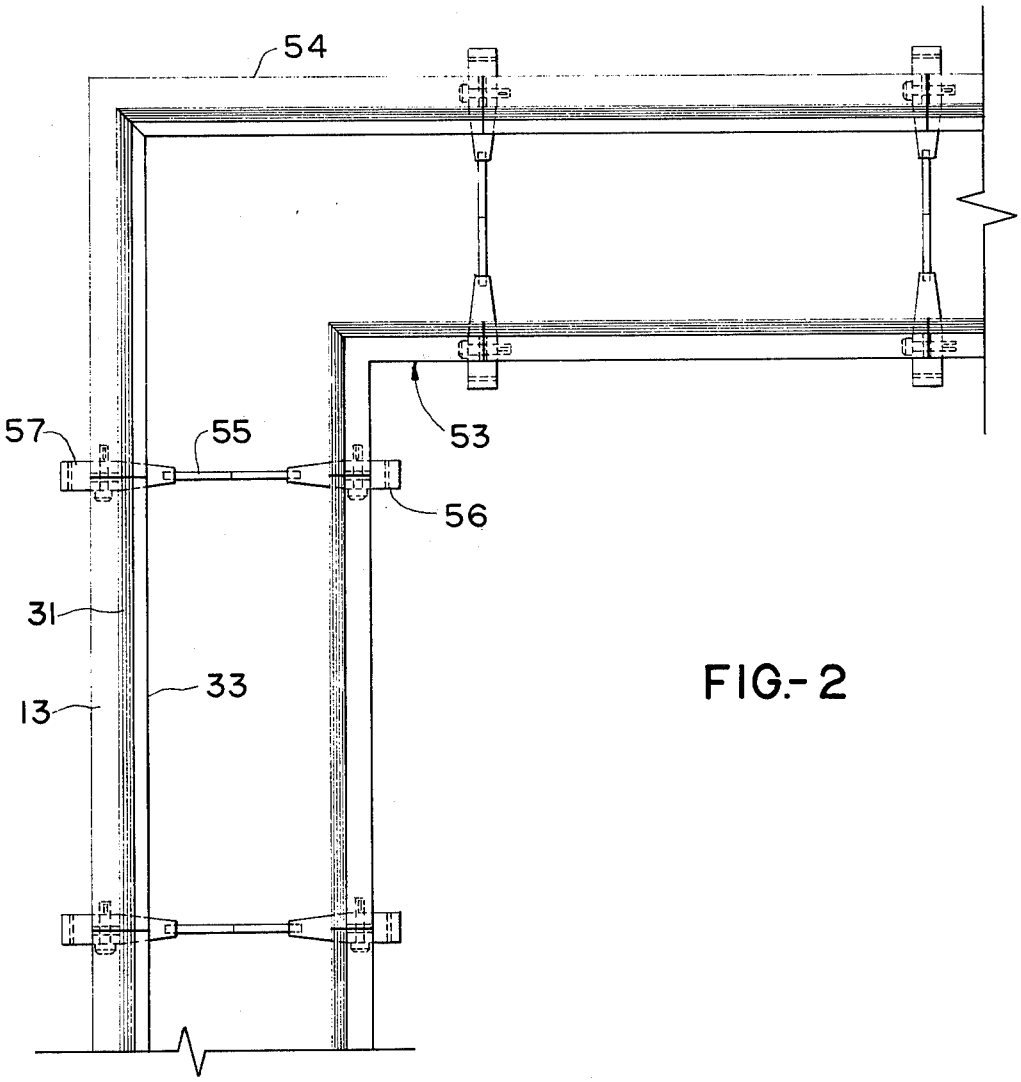
FIG. 2 is a top view showing a group of interconnected form units at a corner of a wall.
Figure 4:
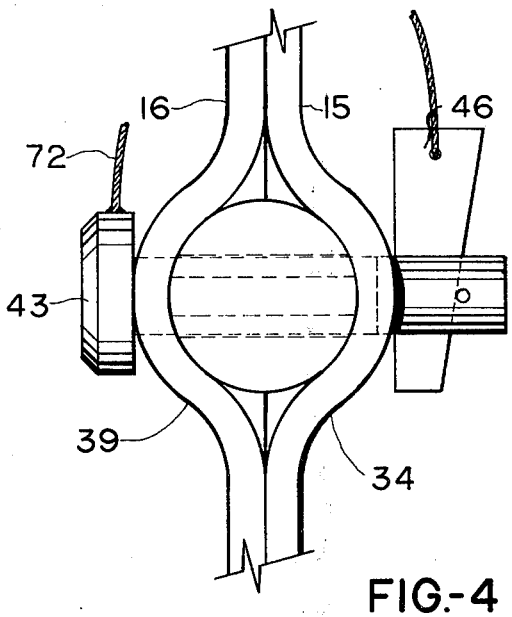
FIG. 4 is a front elevation on an enlarged scale at the junction of one of the tie bolts with the marginal discontinuities of the frames of adjacent form units.

The nature of these tie systems is best shown in FIG. 2. In this view, a series of units similar to that shown in FIG. 1 have been erected in position to establish a wall corner, in cooperation with the inner and outer corner forms 53 and 54, respectively. These are interconnected to the FIG. 1-type forms in the same manner as the adjacent units which are in coplanar relationship. The individual tie systems each include the central rod 55 in threaded interengagement with the opposite bolts 56 and 57, which are cross-pinned to the adjacent form units.

Figure 7:
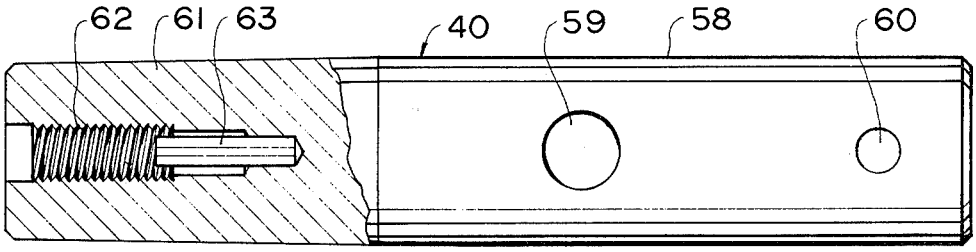
FIG. 7 is an enlarged view, partially in section, of the bolt component of one of the tie systems.

FIG. 7 illustrates the bolt component of the tie system. The cylindrical body portion 58 is provided with a diametral hole 59 for receiving the cross pins, and with a second diametral hole 60 to be used for the insertion of a cross rod for applying torque to tighten and remove the bolts. The integral tapered portion 61 has a threaded axial hole 62 for receiving the similarily threaded end of the central tie rods 55. A roll pin 63 is press-fitted into an anterior portion of the bore extending beyond the threaded portion 62 to establish a positive abutment for the end of the rods 55 to accurately establish the spaced relationship of the forms at the opposite sides of the wall. This arrangement itself is not new, but functions very effectively in conjunction with the intersection of the cross pins with the holes 59 and the form frames to establish both the initial spacing of the forms and the resistance of the form pressures in a single fastening having a minimum accumulation of tolerances.

Figure 8:
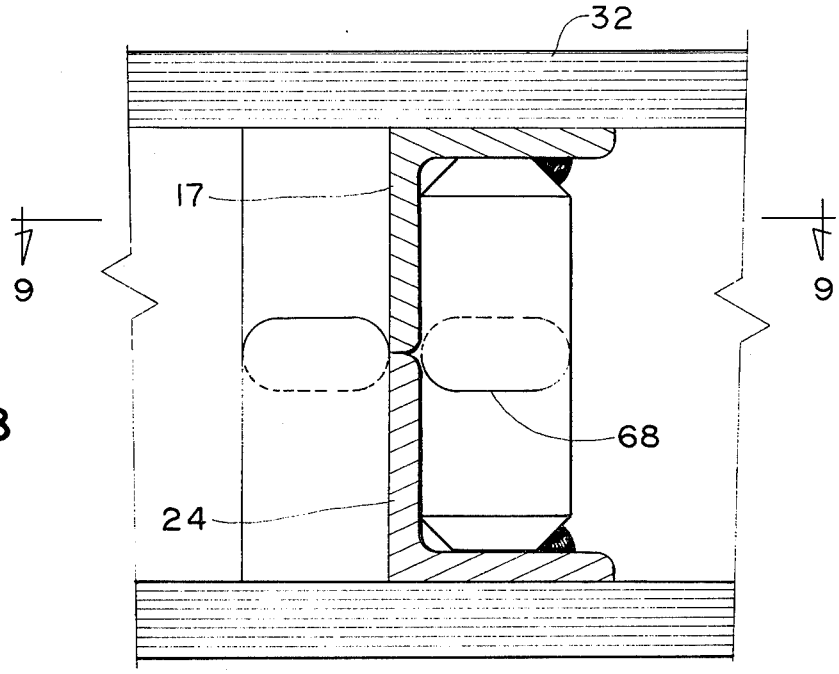
FIG. 8 is an enlarged view of a pair of form units in back-to-back relationship, at the junction of the interengaged locating pins.
Figure 9:
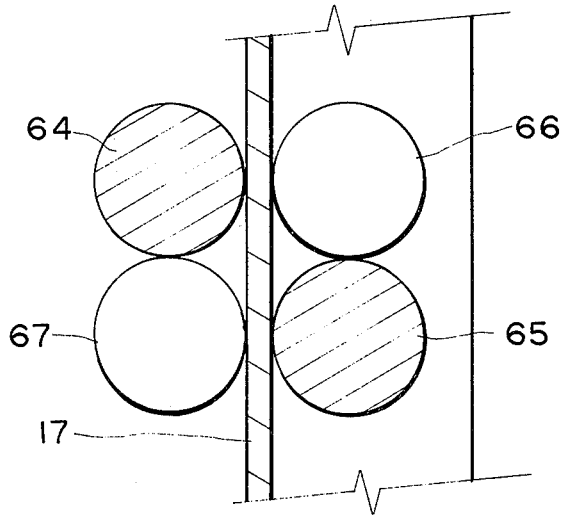
FIG. 9 is a view on the plane 9—9 of FIG. 8.

When the form units are not in use, it is recommended that they be stacked back-to-back. Referring to FIGS. 1, 8, and 9, the form unit 10 has the pairs of positioning projections or studs 64–65 and 66–67. The members constituting each of these pairs are staggered laterally with respect to each other, and in a vertical alignment such that a form unit 10 can be flipped over either about its longitudinal or its transverse axis, and the pins 64–65 of that form would then register with the pins 66–67 of the mating form in the manner illustrated in FIG. 9. The pins are primarily cylindrical, and are welded either at their bevelled ends to the base of the angle-shaped transverse members, or along the opposite flange. The length of these pins is such that the rounded ends shown at 68 in FIG. 8 project slightly beyond the plane of the outer edge of the frame. The height dimensions of the side members 15 and 16 are preferably the same as those of the transverse members as shown at 17 in FIG. 8, so that the studs may be considered as projecting beyond a plane tangent to these edges of the frame members. This projection permits the ends of the pins to interengage in the manner shown in FIG. 9 to determine the relative lateral position of the form units which are thus stacked in pairs. These ends of the pins are preferably flattened, with rounded edges, to minimize a tendency to mar the forming face of panels that happen to be accidentally placed in the wrong relative position against each other.

The form units shown in FIG. 1 can be constructed in small enough configurations to permit manual handling. For this reason, they are provided with handles as shown at 69 and 70 in FIG. 1, which are essentially U-shaped rods with threaded ends, and which are secured by having these ends traverse appropriate holes in the horizontal flanges of the transverse members 17 and 24, and secured there with pairs of nuts as shown. The handles are thus also disposed within the space defined by the frame, which may be considered as the space between the tangent plane referred to above and the form panels 32.

The protected space established by the stacked position of the form units is also utilized to establish a storage position for the bolt components of the tie system. Preferably, each form unit should provide storage for enough bolts and the other fastenings to secure that form element on one side. This storage arrangement has the added effect of protecting the bolts from the elements, as well as from being detached and separated from the point for use. Other components of the securing system may also be kept in close proximity to the point of use by such means as applying cords or cables as shown at 72 for retaining the wedges that operate in conjunction with the cross pins. A storage arrangement for these components is provided by the bars 73–74 extending between the members 16 and 16. The bars 73–74 are spaced at a distance to receive the bolts, between them, and these bars correspond in thickness to the members 15 and 16. The thickness of the bar 75, together with that of the flange of the member 21 to which it is welded, corresponds to the two thicknesses of frame material traversed by the shorter pins. These components are all thus stored within the space defined by the frame.

Figure 6:
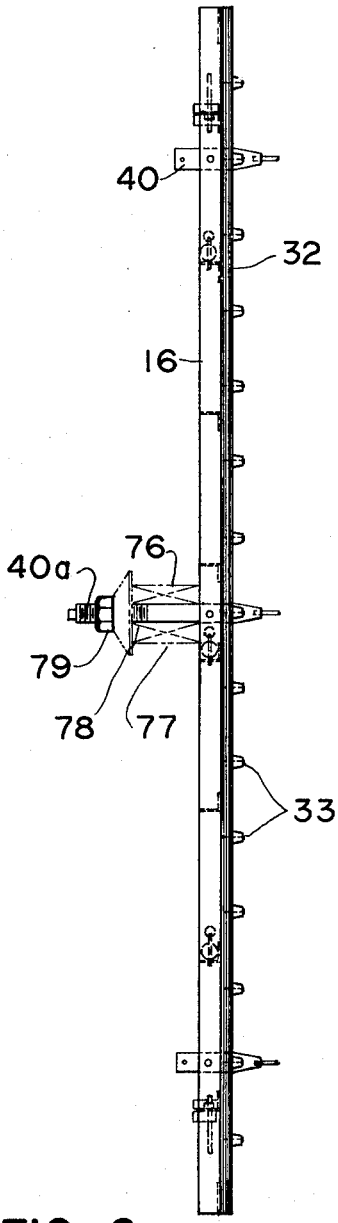
FIG. 6 is a side elevation showing a form system reinforced by "walers", and provided with a modified forming face to establish grooves in the poured concrete for design purposes.

Referring to FIG. 6, the side elevation shows the use of a special bolt **40*a* with an increased length to accommodate the waler beams 76–77 shown in dotted lines, and a standard bearing member 78 used to bridge across them to transfer forces to the bolt via a standard nut 79**. This form of reinforcement is standard in form structure, and is an optional addition to the structure previously described.

I claim:

1. A concrete wall-form unit having a marginal frame and panel means secured to said frame to provide a forming surface, said frame and panel having aligned marginal discontinuities for receiving fastening assemblies traversing said panel, wherein the improvement comprises:

a plurality of groups of positioning projections disposed on the opposite side of said units from said forming surface, said projections in said groups being positioned to interengage with said units in back-to-back relationship to establish the relative lateral position of said units.

2. A wall form unit as defined in claim 1, wherein said frame includes transverse members, and said projections are secured to certain of said members.

3. A wall form unit as defined in claim 2, wherein said transverse members provide a flange perpendicular to said forming surface, and said groups of projections are pairs of substantially cylindrical pins secured to opposite sides of said flange.

4. A wall form unit as defined in claim 2, additionally including bolt-retaining means on certain of said transverse members establishing a storage position of bolts adapted to secure said wall form units in spaced relationship.

5. A wall form unit as defined in claim 2, additionally including bars secured to said frame, and provided with apertures for receiving interengaged components of said fastening assemblies in storage position, said components being disposed within the space defined by said frame.

6. A wall form unit as defined in claim 2, additionally including handle means secured to certain of said transverse members within the space defined by (a) the face of said panel means opposite from said forming surface, (b) a plane tangent to the edges of said frame most remote from said panel means.

7. A wall form unit as defined in claim 5, additionally including diagonal corner members on said frame adjacent to said panel means, and fastening means securing said panel means to said corner members to constitute the means securing said panel means to said frame, said fastening means being confined to the space between said forming face and said tangent plane.

8. A form system for constructing concrete walls, said system including a plurality of form units each having a marginal frame and panel means secured to said frame to provide a forming surface, said frame and panel means having aligned marginal discontinuities receiving fastening assemblies interconnecting form units spaced to provide surfaces defining opposite sides of a wall, said assemblies including bolt means traversing said discontinuities, and also including securing means interconnecting adjacent frame portions of said units arranged in coplanar relationship of said forming surfaces, wherein the improvement comprises:

bars secured to said frame, and provided with apertures for receiving interengaged components of said fastening assemblies in storage position, said components being disposed within the space defined by said frame.

* * * * *